US012791230B2

(12) United States Patent
Takata et al.

(10) Patent No.: US 12,791,230 B2
(45) Date of Patent: Nov. 10, 2026

(54) REFRIGERATION SYSTEM

(71) Applicant: MITSUBISHI HEAVY INDUSTRIES, LTD., Tokyo (JP)

(72) Inventors: Ryo Takata, Tokyo (JP); Kazuki Yoshida, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 93 days.

(21) Appl. No.: 19/114,663

(22) PCT Filed: Aug. 30, 2023

(86) PCT No.: PCT/JP2023/031415
§ 371 (c)(1),
(2) Date: Mar. 24, 2025

(87) PCT Pub. No.: WO2024/075438
PCT Pub. Date: Apr. 11, 2024

(65) Prior Publication Data

US 2026/0139879 A1 May 21, 2026

(30) Foreign Application Priority Data

Oct. 7, 2022 (JP) ..... 2022-162041

(51) Int. Cl.
*F25B 9/00* (2006.01)
*F04D 25/02* (2006.01)
(Continued)

(52) U.S. Cl.
CPC ..... *F25B 9/004* (2013.01); *F04D 25/024* (2013.01); *F04D 25/0606* (2013.01); *F04D 29/5806* (2013.01); *F25B 9/06* (2013.01)

(58) Field of Classification Search
CPC ..... F04D 25/0606; F04D 29/5806; F04D 25/024; F25B 9/06
See application file for complete search history.

(56) References Cited

U.S. PATENT DOCUMENTS 5,644,928 A * 7/1997 Uda ..... A63C 19/10 62/402
6,460,353 B2 * 10/2002 Udobot ..... F28D 9/0062 62/275
(Continued)

FOREIGN PATENT DOCUMENTS

EP 1772686 A2 4/2007
JP 4241699 B2 1/2009
(Continued)

OTHER PUBLICATIONS

International Preliminary Report on Patentability issued in corresponding International Application No. PCT/JP2023/031415 mailed Apr. 17, 2025 (16 pages).
(Continued)

*Primary Examiner* — Lionel Nouketcha
(74) *Attorney, Agent, or Firm* — Osha Bergman Watanabe & Burton LLP

(57) ABSTRACT

A refrigeration system includes: a turbo machine including: a rotating shaft; a compressor impeller, a turbine wheel, and an electric motor attached to the rotating shaft; and a casing accommodating the rotating shaft, the compressor impeller, the turbine wheel, and the electric motor; a compressed fluid line for guiding a fluid compressed by the compressor impeller to the turbine wheel; a cooler provided in the compressed fluid line to perform heat exchange between the fluid flowing through the compressed fluid line and a cooling liquid; a cooling liquid circulation line provided with a cooling device for cooling the cooling liquid; and a cooling liquid introduction line for extracting the cooling liquid from the cooling liquid circulation line and introducing the cooling liquid into the casing.

9 Claims, 6 Drawing Sheets

(51) Int. Cl.

| | |
|---|---|
| ***F04D 25/06*** | (2006.01) |
| ***F04D 29/58*** | (2006.01) |
| ***F25B 9/06*** | (2006.01) |

(56) References Cited

U.S. PATENT DOCUMENTS

| | | | | |
|---|---|---|---|---|
| 8,141,380 | B2 * | 3/2012 | Kikuchi | H02K 9/04 62/402 |
| 2007/0101755 | A1 * | 5/2007 | Kikuchi | F04D 29/058 62/402 |
| 2007/0101756 | A1 * | 5/2007 | Okuda | F25B 9/004 62/272 |
| 2018/0087809 | A1 * | 3/2018 | Ueda | F25J 1/0072 |
| 2020/0263698 | A1 * | 8/2020 | Mori | F04D 25/024 |
| 2023/0332607 | A1 | 10/2023 | Shibata et al. | |
| 2024/0068382 | A1 | 2/2024 | Taguchi et al. | |
| 2024/0085066 | A1 | 3/2024 | Ozaki et al. | |

FOREIGN PATENT DOCUMENTS

| | | | |
|---|---|---|---|
| JP | 2018-031483 | A | 3/2018 |
| JP | 2019-173615 | A | 10/2019 |
| JP | 6951598 | B1 | 9/2021 |
| WO | 2006/011248 | A1 | 2/2006 |
| WO | 2006/011297 | A1 | 2/2006 |
| WO | 2022/013985 | A1 | 1/2022 |
| WO | 2022/154098 | A1 | 7/2022 |

OTHER PUBLICATIONS

International Search Report issued in corresponding International Application No. PCT/JP2023/031415 mailed Nov. 21, 2023 (12 pages).

* cited by examiner

REFRIGERATION SYSTEM

TECHNICAL FIELD

The present disclosure relates to a refrigeration system equipped with a turbo machine.

This application claims priority to Japanese Patent Application No. 2022-162041, filed on Oct. 7, 2022, with the Japan Patent Office, the contents of which are incorporated herein by reference.

BACKGROUND

In some conventional refrigerators, air is drawn from a refrigerated warehouse as a refrigerant for an air refrigerant refrigeration device, a compressor compresses the air to a high pressure and high temperature, a cooler cools the air, and an expander reduces the pressure and temperature, thereby obtaining cooling capacity (see PTL 1).

CITATION LIST

Patent Literature

Patent Document 1: Japanese U.S. Pat. No. 4,241,699

SUMMARY

Technical Problem

PTL 1 discloses an air refrigerant refrigeration device that cools the heat generated by a motor using an external cooling air line. By providing an external cooling air line, a turbo machine can be cooled, but there is a risk that the structure of the refrigeration system equipped with the turbo machine will become complicated. If the structure of the refrigeration system is complicated, there is a risk that it will be difficult to make it compact and lightweight.

In view of the circumstances, an object of at least one embodiment of the present invention is to provide a refrigeration system that can cool a turbo machine while preventing the complexity of the structure of the refrigeration system equipped with the turbo machine.

Solution to Problem

A refrigeration system according to an embodiment of the present disclosure includes a turbo machine including: a rotating shaft; a compressor impeller attached to one side of the rotating shaft; a turbine wheel attached to the other side of the rotating shaft; an electric motor attached to the rotating shaft between the compressor impeller and the turbine wheel, the electric motor being configured to generate a rotational force to rotate the rotating shaft; and a casing configured to accommodate the rotating shaft, the compressor impeller, the turbine wheel, and the electric motor; a compressed fluid line for guiding a fluid compressed by the compressor impeller to the turbine wheel; a cooler provided in the compressed fluid line, the cooler being configured to perform heat exchange between the fluid flowing through the compressed fluid line and a cooling liquid; a cooling liquid circulation line for circulating the cooling liquid, the cooling liquid circulation line being provided with a cooling device for cooling the cooling liquid; and a cooling liquid introduction line for extracting the cooling liquid from the cooling liquid circulation line and introducing the cooling liquid into the casing.

Advantageous Effects

According to at least one embodiment of the present disclosure, a refrigeration system capable of cooling a turbo machine while preventing the complexity of the structure of the refrigeration system including the turbo machine is provided.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not limitative of the scope of the present invention.

(Turbo Machine)

Figure 1:
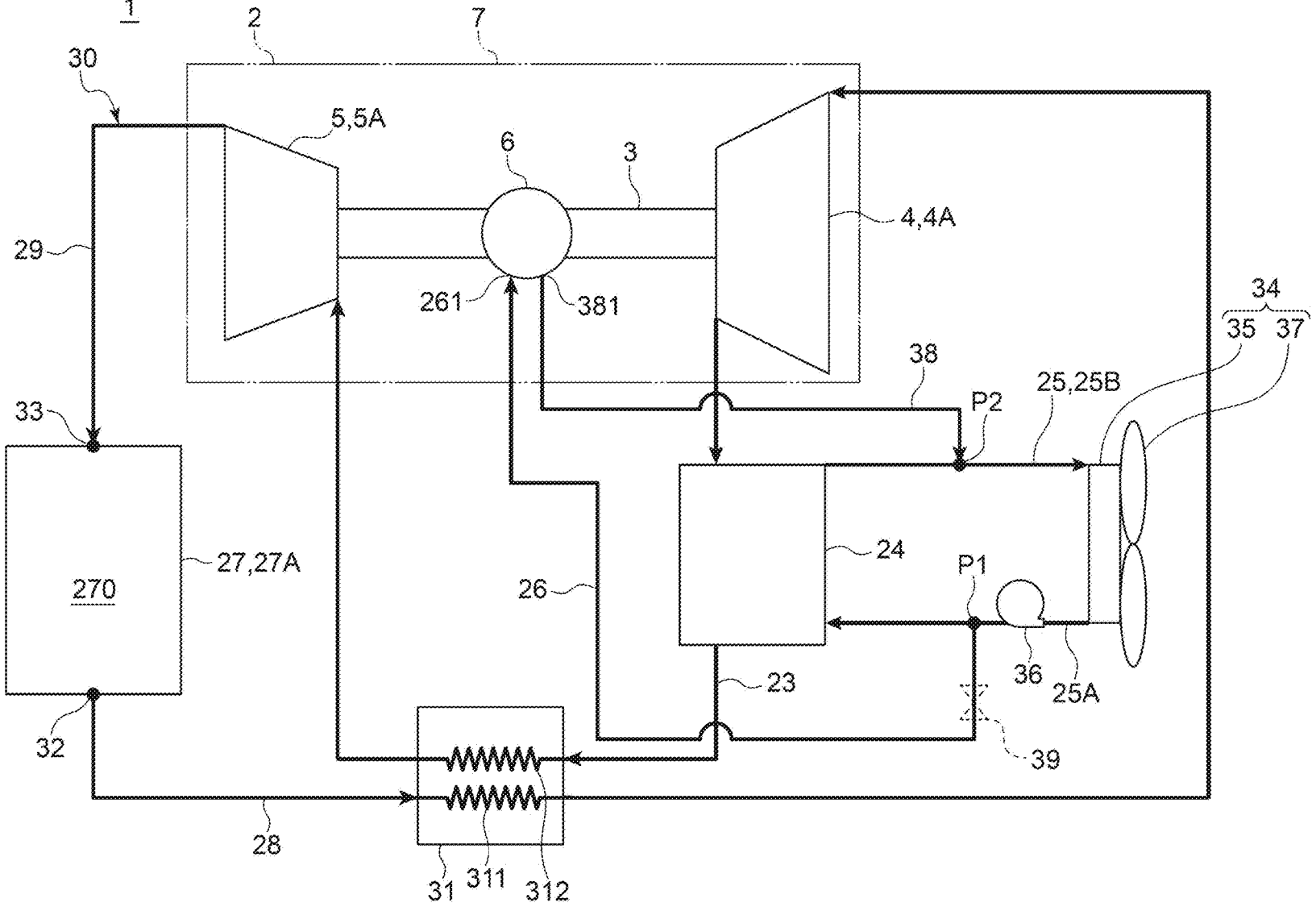
FIG. 1 is a diagram showing a schematic diagram of a refrigeration system according to an embodiment of the present disclosure.
Figure 2:
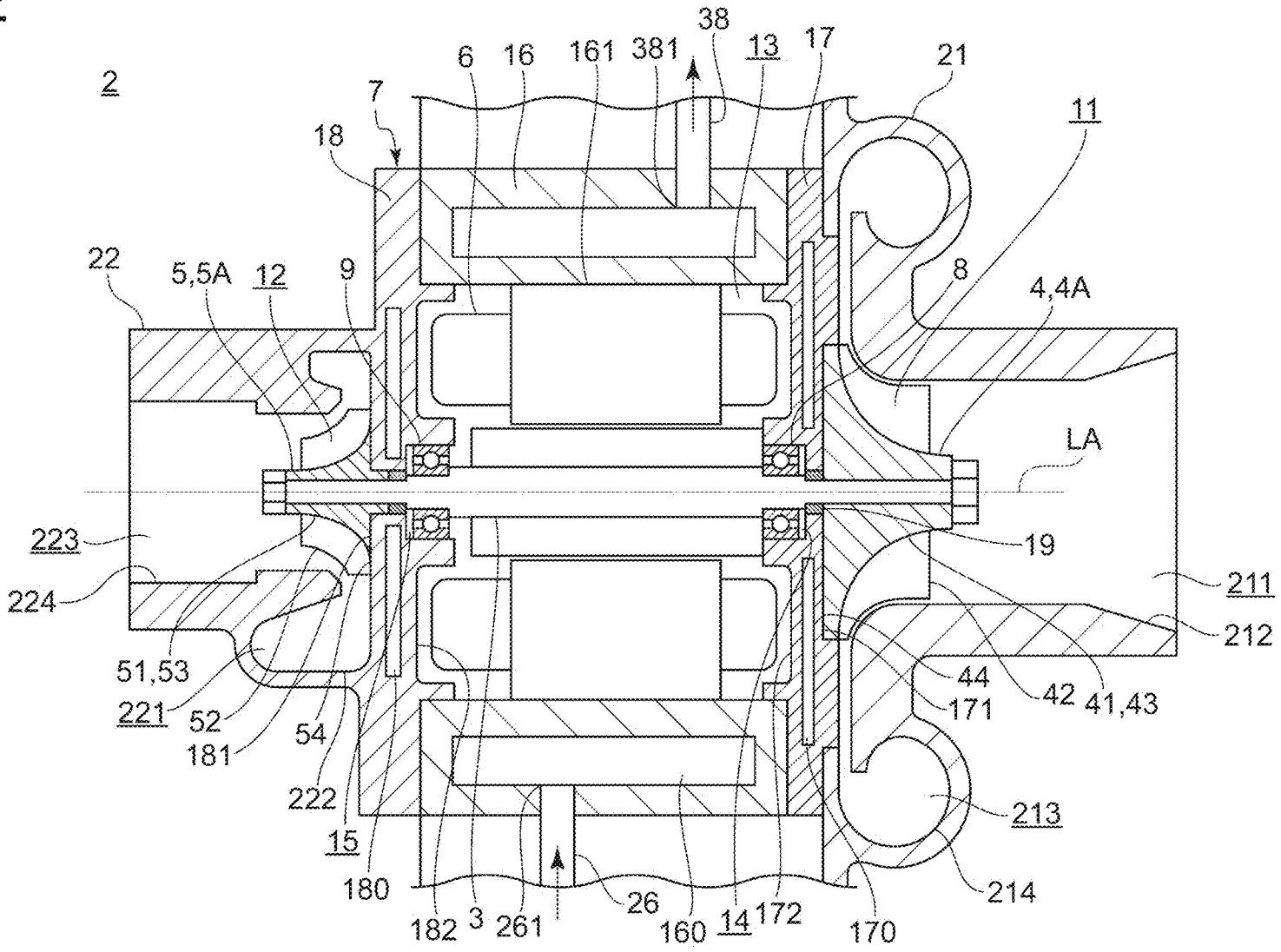
FIG. 2 is a schematic cross-sectional view along the axis of a turbo machine shown in FIG. 1.

FIG. 1 is a schematic diagram of a refrigeration system 1 according to an embodiment of the present disclosure. FIG. 2 is a schematic cross-sectional view along the axis LA of a turbo machine 2 shown in FIG. 1. FIG. 2 shows a cross-section including the axis LA of a rotating shaft 3 of the turbo machine 2. The refrigeration system 1 includes the turbo machine 2 including at least a compressor impeller 4 and a turbine wheel 5, as shown in FIG. 1.

As shown in FIGS. 1 and 2, the turbo machine 2 includes a rotating shaft 3, a compressor impeller 4 (centrifugal compressor) attached to one side of the rotating shaft 3 (right side in FIGS. 1 and 2), a turbine wheel 5 (expander) attached to the other side of the rotating shaft 3 (left side in FIGS. 1 and 2), an electric motor 6 attached to the rotating shaft 3 between the compressor impeller 4 and the turbine wheel 5, and a casing 7 configured to accommodate the rotating shaft 3, the compressor impeller 4, the turbine wheel 5, and the electric motor 6. The electric motor 6 is configured to generate a rotational force that rotates the rotating shaft 3.

The rotating shaft 3 extends along the axis LA of the rotating shaft 3. The compressor impeller 4 is connected to one end of the rotating shaft 3 in the extension direction, and the turbine wheel 5 is connected to the other end of the rotating shaft 3 in the extension direction. In other words, the compressor impeller 4 and the turbine wheel 5 are arranged coaxially with each other via the rotating shaft 3, which is the output shaft of the electric motor 6, and are each connected to the rotating shaft 3.

Hereinafter, the direction in which the axis LA of the rotating shaft 3 extends (the left-right direction in FIG. 2) is defined as the axial direction of the rotating shaft 3 (turbo machine 2), the direction orthogonal to the axis LA is defined as the radial direction of the rotating shaft 3 (turbo machine 2), and the circumferential direction around the axis LA is defined as the circumferential direction of the rotating shaft 3 (turbo machine 2). In the axial direction of the rotating shaft 3 (turbo machine 2), the side where the compressor impeller 4 is located relative to the turbine wheel 5 is the compressor side, and the side where the turbine wheel 5 is located relative to the compressor impeller 4 is the turbine side.

In the illustrated embodiment, the turbo machine 2 further includes a compressor-side bearing 8 configured to rotatably support the rotating shaft 3 between the compressor impeller 4 and the electric motor 6, and a turbine-side bearing 9 configured to rotatably support the rotating shaft 3 between the turbine wheel 5 and the electric motor 6. Each of the compressor-side bearing 8 and the turbine-side bearing 9 is supported by the casing 7. The rotating shaft 3 is supported by the compressor-side bearing 8 and the turbine-side bearing 9 so as to be rotatable around the axis LA of the rotating shaft 3. The electric motor 6 is supplied with current from a power source (such as a generator) (not shown), and is driven by the current supplied from the power source to drive (rotate) the rotating shaft 3, the compressor impeller 4, and the turbine wheel 5.

(Compressor Impeller)

The compressor impeller 4 is driven (rotated) by the electric motor 6 to suck fluid into the casing 7, compress the fluid guided to the compressor impeller 4, and send the fluid to a destination. The compressor impeller 4 is provided so as to be rotatable integrally with the rotating shaft 3 around the axis LA of the rotating shaft 3. The compressor impeller 4 is configured to guide the fluid introduced along the axial direction of the rotating shaft 3 to the outside in the radial direction of the rotating shaft 3.

As shown in FIG. 2, the compressor impeller 4 includes a hub 41 having a substantially truncated cone shape fixed to the one end side of the rotating shaft 3, and a plurality of impeller blades 42 provided around the hub 41. The outer circumferential surface 43 of the hub 41 is formed in a concave curved shape in which the distance from the axis LA increases toward the turbine side (the back surface 44 side of the hub 41) in the axial direction of the rotating shaft 3. Each of the plurality of impeller blades 42 stands upright from the outer circumferential surface 43 of the hub 41, and is disposed at intervals between the other impeller blades 42 in the circumferential direction about the axis LA. In the illustrated embodiment, the compressor impeller 4 is an open-type impeller that does not include an annular member covering the tip of each of the plurality of impeller blades 42.

(Turbine Wheel)

The turbine wheel 5 rotates by recovering a portion of the energy of the fluid guided to the turbine wheel 5. The energy of the fluid recovered by the turbine wheel 5 assists in driving (rotating) the compressor impeller 4. The turbine wheel 5 is provided so as to be rotatable integrally with the rotating shaft 3 around the axis LA of the rotating shaft 3. The turbine wheel 5 is configured to guide the fluid introduced from the outside in the radial direction of the rotating shaft 3 along the axial direction of the rotating shaft 3.

As shown in FIG. 2, the turbine wheel 5 includes a hub 51 having a substantially truncated cone shape fixed to the other end side of the rotating shaft 3, and a plurality of turbine blades 52 provided around the hub 51. The outer circumferential surface 53 of the hub 51 is formed in a concave curved shape in which the distance from the axis LA increases toward the compressor side (the back surface 54 side of the hub 51) in the axial direction of the rotating shaft 3. Each of the turbine blades 52 stands upright from the outer circumferential surface 53 of the hub 51, and is arranged at intervals between the other turbine blades 52 in the circumferential direction around the axis LA.

(Casing)

As shown in FIG. 2, the casing 7 is formed with a compressor-side storage space 11 that rotatably accommodates the compressor impeller 4, a turbine-side storage space 12 that rotatably accommodates the turbine wheel 5, and a motor compartment 13 that accommodates the electric motor 6. The electric motor 6 includes a rotor attached between the compressor-side bearing 8 and the turbine-side bearing 9 of the rotating shaft 3, and a stator that is arranged with a gap from the rotor so as to cover the outer circumferential side of the rotor and is supported by the casing 7. The rotor of the electric motor 6 is arranged in the motor compartment 13 and is rotatable integrally with the rotating shaft 3. The stator of the electric motor 6 is arranged further outside the rotor in the radial direction in the motor compartment 13. The stator of the electric motor 6 is supported on the wall surface (at least one of the outer wall 16, the compressor-side partition wall 17, and the turbine-side partition wall 18) that forms the motor compartment 13. The casing 7 is also formed with a compressor-side communication hole 14 allowing communication between the compressor-side storage space 11 and the motor compartment 13, and a turbine-side communication hole 15 allowing communication between the turbine-side storage space 12 and the motor compartment 13. Each of the compressor-side communication hole 14 and the turbine-side communication hole 15 extends along the extension direction of the rotating shaft 3, and the rotating shaft 3 is inserted through the holes. The compressor-side bearing 8 is provided inside the compressor-side communication hole 14. The turbine-side bearing 9 is provided inside the turbine-side communication hole 15.

The casing 7 includes an outer wall 16 that covers the outer circumferential side of the motor compartment 13, a compressor-side partition wall 17 that separates the compressor-side storage space 11 from the motor compartment 13, and a turbine-side partition wall 18 that separates the turbine-side storage space 12 from the motor compartment 13. The outer wall 16 is formed in a cylindrical shape extending along the extension direction of the rotating shaft 3, and separates the outside of the outer wall 16 from the motor compartment 13. Each of the compressor-side partition wall 17 and the turbine-side partition wall 18 is formed in an annular shape extending along a direction intersecting (orthogonal to) the axis LA of the rotating shaft 3. The compressor-side communication hole 14 is formed by the inner circumferential surface of the compressor-side partition wall 17. The turbine-side communication hole 15 is formed by the inner circumferential surface of the turbine-side partition wall 18.

The outer wall 16 has an inner surface 161 facing the motor compartment 13. The compressor-side partition wall 17 has a compressor-side back surface 171 facing the compressor-side storage space 11 and a compressor-side inner surface 172 facing the motor compartment 13. The back surface 44 of the compressor impeller 4 faces the compressor-side back surface 171 through a gap. The turbine-side partition wall 18 has a turbine-side back surface 181 facing the turbine-side storage space 12 and a turbine-side inner surface 182 facing the motor compartment 13. The back surface 54 of the turbine wheel 5 faces the turbine-side back surface 181 through a gap. The motor compartment 13 is formed by the inner surface 161, the compressor-side inner surface 172, and the turbine-side inner surface 182.

(Compressor Housing, Turbine Housing)

The casing 7 further includes a compressor housing 21 that forms the compressor-side storage space 11 with the compressor-side back surface 171 and a turbine housing 22 that forms the turbine-side storage space 12 with the turbine-side back surface 181. The compressor impeller 4, the compressor housing 21, and the compressor-side partition wall 17 form a centrifugal compressor 4A of the turbo machine 2. The turbine wheel 5, the turbine housing 22, and the turbine-side partition wall 18 form an expander 5A of the turbo machine 2. In the illustrated embodiment, the compressor-side partition wall 17 is formed separately from the compressor housing 21 and the outer wall 16, but may be formed integrally with either the compressor housing 21 or the outer wall 16. In addition, the turbine-side partition wall 18 is formed separately from the turbine housing 22 and the outer wall 16, but may be formed integrally with either the turbine housing 22 or the outer wall 16.

The compressor housing 21 further has a fluid introduction flow path forming section 212 that forms the fluid introduction flow path 211, and a scroll flow path forming section 214 that forms the scroll flow path 213. That is, the fluid introduction flow path 211 and the scroll flow path 213 are formed inside the compressor housing 21. The scroll flow path 213 is provided on the outer circumferential side of the compressor impeller 4 and is a spiral flow path extending along the circumferential direction of the rotating shaft 3.

The fluid introduction flow path 211 is a flow path for drawing a fluid from outside the compressor housing 21 and guiding the drawn fluid to the compressor impeller 4. The fluid introduction flow path 211 extends along the axial direction of the rotating shaft 3. By driving the compressor impeller 4, fluid is drawn from outside the compressor housing 21 into the fluid introduction flow path 211, and the drawn fluid flows through the fluid introduction flow path 211 and is guided to the compressor impeller 4. The fluid that has passed through the compressor impeller 4 flows through the scroll flow path 213 and is then discharged outside the compressor housing 21.

The turbine housing 22 further has a scroll flow path forming section 222 that forms the scroll flow path 221 and a fluid discharge flow path forming section 224 that forms the fluid discharge flow path 223. That is, the scroll flow path 221 and the fluid discharge flow path 223 are formed inside the turbine housing 22. The scroll flow path 221 is provided on the outer circumferential side of the turbine wheel 5 and is a spiral flow path extending along the circumferential direction of the rotating shaft 3.

The scroll flow path 221 is a flow path for guiding the fluid introduced from outside the turbine housing 22 to the turbine wheel 5. The fluid discharge flow path 223 is a flow path for discharging the fluid that has passed through the turbine wheel 5 to the outside of the turbine housing 22. The fluid discharge flow path 223 extends along the axial direction of the rotating shaft 3. The fluid introduced from outside the turbine housing 22 flows through the scroll flow path 221 and is guided to the turbine wheel 5. The fluid that has passed through the turbine wheel 5 flows through the fluid discharge flow path 223 and is then discharged outside the turbine housing 22.

(Refrigeration System)

As shown in FIG. 1, the refrigeration system 1 includes the turbo machine 2, the compressed fluid line 23, the cooler 24, the cooling liquid circulation line 25, and the cooling liquid introduction line 26. The turbo machine 2, the compressed fluid line 23, and the cooler 24 constitute a refrigerator (refrigeration cycle) 30 that uses the fluid as a heat medium. By sending the fluid cooled in the refrigerator 30 to a fluid supply destination 27, it is possible to adjust the temperature by lowering the temperature of the fluid supply destination 27. In the following embodiment, the container body 27A will be described as a specific example of the fluid supply destination 27, but the fluid supply destination 27 is not limited to the container body 27A.

The container body 27A has an inner space 270 capable of accommodating items such as cargo. The refrigerator 30 is configured to be capable of cooling a fluid such as air inside the container body 27A (i.e., the inner space 270). The container body 27A has a plurality of walls forming the inner space 270. Each of the plurality of walls separates the inner space 270 of the container body 27A from the outside of the container body 27A. The container body 27A may be a shipping container used for transporting cargo or the like. The container body 27A may be a standard shipping container such as a 10-ft container, a 20-ft container, or a 40-ft container.

In the illustrated embodiment, the refrigerator 30 of the refrigeration system 1 further includes a fluid introduction line 28 for guiding a fluid to the compressor impeller 4, an expansion fluid line 29 for guiding a fluid expanded by the turbine wheel 5 to the container body 27A, and a heat exchanger 31. The upstream end of the fluid introduction line 28 is connected to the container body 27A. The fluid introduction line 28 has a suction port 32 (opening) for sucking in a fluid such as air inside the container body 27A. The downstream end of the expansion fluid line 29 is connected to the container body 27A. The expansion fluid line 29 has a blowout port 33 (opening) for blowing a fluid such as air into the container body 27A. Each of the suction port 32 and the blowout port 33 is formed in the inner space 270 of the container body 27A.

The refrigerator 30 is configured to extract the fluid inside the container body 27A and use the fluid as a heat medium. The refrigerator 30 may have a heat exchanger configured to exchange heat between the fluid inside the container body 27A and the heat medium, and may be configured to use the heat medium that is heat-exchanged with the fluid inside the container body 27A in the heat exchanger.

Each of the fluid introduction line 28, the compressed fluid line 23, and the expansion fluid line 29 is formed by piping. Note that the respective pipings forming the fluid introduction line 28, the compressed fluid line 23, and the expansion fluid line 29 may be formed by connecting a plurality of piping portions via flanges or the like.

The fluid introduction line 28, the compressed fluid line 23, and the expansion fluid line 29 are configured to flow the fluid sucked from inside the container body 27A through the suction port 32. The compressor impeller 4 (centrifugal compressor 4A) is configured to compress the fluid sucked from inside the container body 27A through the suction port 32. By driving the compressor impeller 4 (centrifugal compressor 4A), the fluid inside the container body 27A is sucked into the fluid introduction line 28 through the suction port 32. The fluid compressed by the compressor impeller 4 is heated and pressurized higher than before it is introduced into the compressor impeller 4, becoming a high-temperature, high-pressure fluid.

(Compressed Fluid Line)

The compressed fluid line 23 is a flow path for guiding the fluid compressed by the compressor impeller 4 to the turbine wheel 5. The compressed fluid line 23 has an upstream end connected to the centrifugal compressor 4A (e.g., a fluid outlet port of the compressor housing 21) and a downstream end connected to the expander 5A (e.g., a fluid inlet port of the turbine housing 22). The fluid compressed by the compressor impeller 4 is guided to the turbine wheel 5 through the compressed fluid line 23.

(Heat Exchanger)

The heat exchanger 31 is configured to cool the high-temperature, high-pressure fluid compressed in the centrifugal compressor 4A. In the illustrated embodiment, the heat exchanger 31 is configured to perform heat exchange between the fluid flowing through the fluid introduction line 28 and the fluid flowing through the compressed fluid line 23. The fluid flowing through the compressed fluid line 23 is compressed by the compressor impeller 4, and is therefore at a higher temperature than the fluid flowing through the fluid introduction line 28. By the heat exchange in the heat exchanger 31, the fluid flowing through the compressed fluid line 23 is cooled by the fluid flowing through the fluid introduction line 28, and the fluid flowing through the fluid introduction line 28 is heated by the fluid flowing through the compressed fluid line 23. The heat exchanger 31 includes a low-temperature-side heat exchange section 311 through which the fluid provided in the fluid introduction line 28 flows, and a high-temperature-side heat exchange section 312 through which the fluid provided in the compressed fluid line 23 flows, and heat is transferred from the fluid flowing through the high-temperature-side heat exchange section 312 to the fluid flowing through the low-temperature-side heat exchange section 311.

(Cooler)

As shown in FIG. 1, the cooler 24 is provided between the compressor impeller 4 of the compressed fluid line 23 and the heat exchanger 31 (high-temperature-side heat exchange section 312) (upstream of the heat exchanger 31 of the compressed fluid line 23), and is configured to perform heat exchange between the fluid flowing through the compressed fluid line 23 and a cooling liquid (e.g., water) that is lower in temperature than the fluid. The fluid flowing through the compressed fluid line 23 toward the heat exchanger 31 is cooled by the cooling liquid through heat exchange in the cooler 24. The fluid cooled in the cooler 24 is introduced through the compressed fluid line 23 to the heat exchanger 31 (high-temperature-side heat exchange section 312).

(Cooling Liquid Circulation Line)

The cooling liquid circulation line 25 is a flow path for circulating the cooling liquid. The cooling liquid is supplied to the cooler 24 through the cooling liquid circulation line 25. Specifically, the cooling liquid circulation line 25 is provided with a radiator 35 constituting a cooling device 34 for cooling the cooling liquid, and a pump 36 for sending the cooling liquid through the cooling liquid circulation line 25. The cooling device 34 includes the radiator 35 and the fan 37 for air-cooling the radiator 35. The cooling liquid whose temperature has increased by heat exchange with the fluid flowing through the compressed fluid line 23 in the cooler 24 is sent to the cooling liquid circulation line 25 by the pump 36 and cooled by the cooling device 34 including the radiator 35. The cooling liquid cooled by the cooling device 34 is supplied to the cooler 24 through the cooling liquid circulation line 25. The refrigerant circulating through the cooling liquid circulation line 25 is not limited to a liquid state and may be a gas state. The refrigerant circulating through the cooling liquid circulation line 25 may be, for example, a fluorine-based refrigerant (refrigerant gas) such as R-1234ZE, or may be, for example, an antifreeze solution such as glycol water. It is preferable that the refrigerant circulating through the cooling liquid circulation line 25 has a lower freezing point than water.

The turbine wheel 5 (expander 5A) is configured to expand the fluid cooled in the cooler 24 and the heat exchanger 31. The low-temperature fluid expanded in the expander 5A is guided to the blowout port 33 through the expansion fluid line 29, and is blown out from the blowout port 33 into the container body 27A.

(Cooling Liquid Introduction Line)

As shown in FIG. 1, the refrigeration system 1 according to some embodiments includes at least the turbo machine 2, the compressed fluid line 23, the cooler 24, the cooling liquid circulation line 25, and the cooling liquid introduction line 26.

The cooling liquid introduction line 26 is a flow path for extracting the cooling liquid from the cooling liquid circulation line 25 and introducing the cooling liquid into the casing 7. The cooling liquid introduction line 26 is formed by piping. Note that the respective pipings forming the cooling liquid introduction line 26 may be formed by connecting a plurality of piping portions via flanges or the like. In the illustrated embodiment, the cooling liquid introduction line 26 has a cooling liquid blowout port 261 (opening) for blowing out the cooling liquid extracted from the cooling liquid circulation line 25 into the casing 7. The cooling liquid blowout port 261 is formed inside the casing 7.

According to the configuration, the cooling liquid circulating through the cooling liquid circulation line 25 is cooled in the cooling device 34, so that a relatively low temperature is maintained. The refrigeration system 1 can cool the inside of the casing 7 (turbo machine 2) by extracting the cooling liquid from the cooling liquid circulation line 25 through the cooling liquid introduction line 26 and introducing the cooling liquid into the casing 7 of the turbo machine 2. Furthermore, according to the configuration, the cooling liquid circulation line 25 provided in the refrigeration system 1 can be used as a cooling device for cooling the inside of the casing 7, and since there is no need to provide the cooling device separately, the structure of the refrigeration system 1 provided with the turbo machine 2 can be prevented from becoming complicated.

In some embodiments, as shown in FIG. 1, the refrigeration system 1 further includes a cooling liquid recovery line 38 for extracting the cooling liquid introduced into the casing 7 through the cooling liquid introduction line 26 from inside the casing 7 and guiding it to the cooling liquid circulation line 25. The cooling liquid recovery line 38 is formed by piping. Note that the respective pipings forming the cooling liquid recovery line 38 may be formed by connecting a plurality of piping portions via flanges or the like. In the illustrated embodiment, the cooling liquid recovery line 38 has the cooling liquid suction port 381 (opening) for sucking in the cooling liquid introduced into the casing 7.

According to the configuration, the refrigeration system 1 recovers the cooling liquid from inside the casing 7 to the cooling liquid circulation line 25 through the cooling liquid recovery line 38, making it possible to reuse the recovered cooling liquid, and reducing the frequency of refilling the cooling liquid to the cooling liquid circulation line 25.

(Cooling Liquid Flow Rate Control Device)

In some embodiments, as shown in FIG. 1, the refrigeration system 1 further includes a cooling liquid flow rate control device (cooling liquid flow rate control valve) 39 that is provided in the cooling liquid introduction line 26 and configured to be able to adjust the flow rate of the cooling liquid flowing through the cooling liquid introduction line 26. The cooling liquid flow rate control device 39 is configured to be able to adjust the flow rate of the cooling liquid introduced downstream of the cooling liquid flow rate control device 39 (the cooling liquid blowout port 261 side) by changing the opening degree of the valve body arranged in the cooling liquid introduction line 26. The cooling liquid flow rate control device 39 may be an opening/closing valve whose opening degree can be adjusted to fully-closed and fully-open states, or may be an opening degree control valve whose opening degree can be adjusted to fully-closed and fully-open states, and at least one intermediate opening degree between the states. In addition, the refrigeration system 1 according to some embodiments of the present disclosure can also be applied to a refrigeration system 1 that does not include the cooling liquid flow rate control device 39.

In some embodiments, as shown in FIG. 1, the cooling liquid circulation line 25 includes a cooling liquid supply line 25A for sending cooling liquid from the radiator 35 (cooling device 34) to the cooler 24, and a cooling liquid return line 25B for sending cooling liquid from the cooler 24 to the radiator 35 (cooling device 34). The cooling liquid introduction line 26 is connected to the cooling liquid supply line 25A.

In the illustrated embodiment, the cooling liquid supply line 25A is provided with the pump 36. The upstream end of the cooling liquid introduction line 26 is connected to the cooling liquid supply line 25A at a connection position P1 located between the pump 36 of the cooling liquid supply line 25A and the cooler 24.

According to the configuration, the cooling liquid cooled by the cooling device 34 can be introduced into the casing 7. In this case, the cooling liquid introduced into the casing 7 can be cooled to a lower temperature than when the cooling liquid that has been heated by passing through the cooler 24 is introduced into the casing 7, so that the inside of the casing 7 can be cooled more effectively by the cooling liquid.

In the illustrated embodiment, the downstream end of the cooling liquid recovery line 38 is connected to the cooling liquid return line 25B at the connection position P2 of the cooling liquid return line 25B. In this case, the cooling liquid recovered from inside the casing 7 through the cooling liquid recovery line 38 is introduced into the cooling device 34.

(Motor-Side Internal Space, Compressor-Side Internal Space, Turbine-Side Internal Space)

Figure 3:
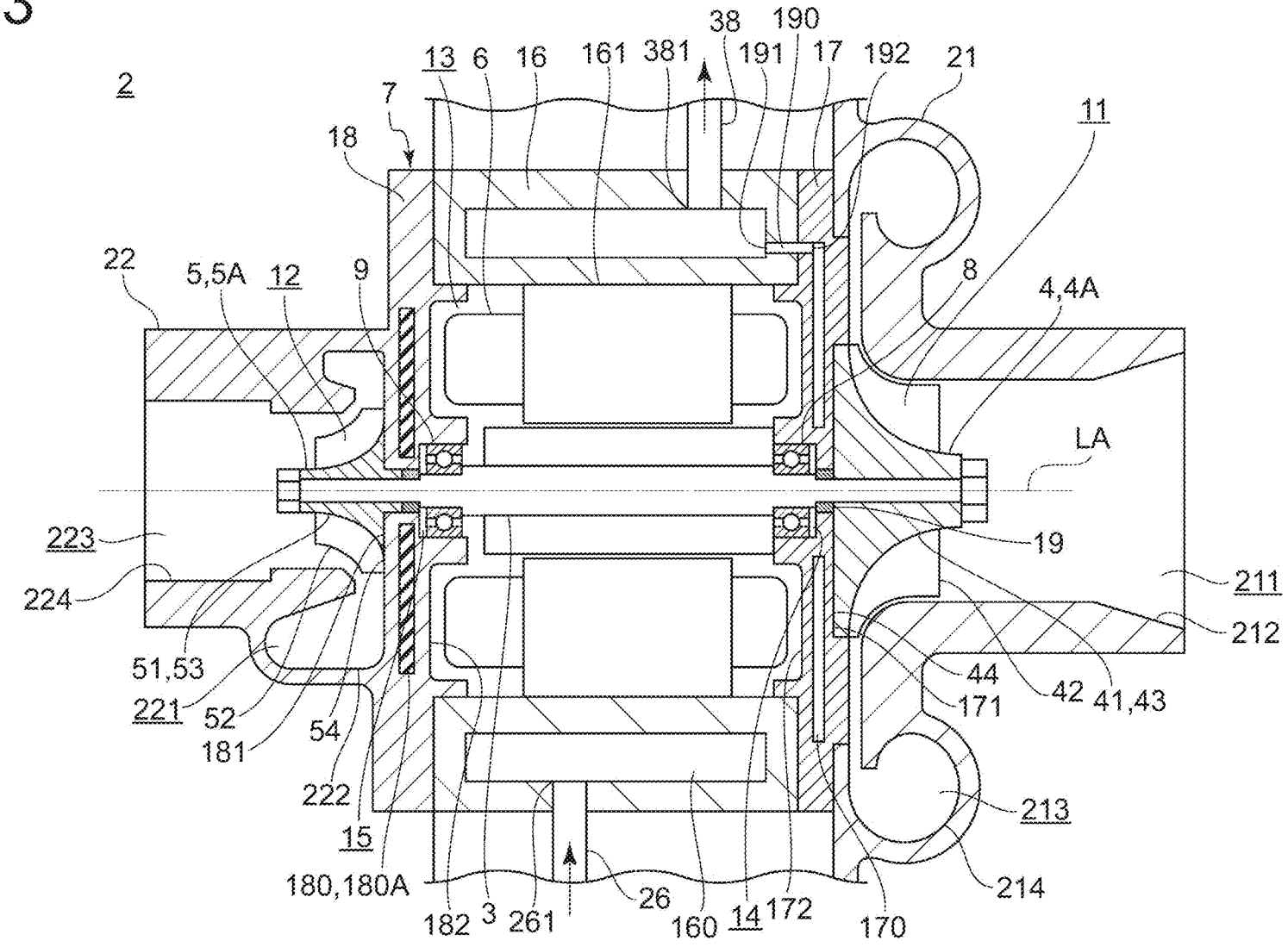
FIG. 3 is a schematic cross-sectional view along the axis of a modified example of a turbo machine shown in FIG. 2.

FIG. 3 is a schematic cross-sectional view along the axis LA of a modified example of the turbo machine 2 shown in FIG. 2. In FIG. 3, a cross section including the axis LA of the rotating shaft 3 of the turbo machine 2 is shown.

In some embodiments, as shown in FIGS. 2 and 3, the casing 7 includes the outer wall 16, the compressor-side partition wall 17, and the turbine-side partition wall 18. The casing 7 is formed at least one of the motor-side internal space 160 formed inside the outer wall 16, the compressor-side internal space 170 formed inside the compressor-side partition wall 17, and the turbine-side internal space 180 formed inside the turbine-side partition wall 18. The cooling liquid introduction line 26 is connected to either the motor-side internal space 160, the compressor-side internal space 170, or the turbine-side internal space 180.

Each of the motor-side internal space 160, the compressor-side internal space 170, and the turbine-side internal space 180 may be formed in an arc shape or an annular shape extending along the circumferential direction of the rotating shaft 3. Here, extending along the circumferential direction of the rotating shaft 3 does not mean that the internal spaces 160, 170, and 180 are limited to flow paths extending along the circumferential direction, and may include flow paths extending in either the axial direction or the radial direction in addition to the flow paths extending along the circumferential direction. For example, the motor-side internal space 160 may be a serpentine flow path that alternately combines flow paths extending along the circumferential direction and flow paths extending in the axial direction. Each of the motor-side internal space 160, the compressor-side internal space 170, and the turbine-side internal space 180 is not connected to any of the compressor-side storage space 11, the turbine-side storage space 12, and the motor compartment 13.

The motor-side internal space 160 may have a cross-sectional shape formed in a rectangular shape or an elongated hole shape having a longitudinal direction along the axial direction in a cross section including the axis LA as shown in FIGS. 2 and 3. In addition, each of the compressor-side internal space 170 and the turbine-side internal space 180 may have a cross-sectional shape formed in a rectangular shape or an elongated hole shape having a longitudinal direction along the radial direction in a cross section including the axis LA as shown in FIGS. 2 and 3.

In the illustrated embodiment, the downstream end of the cooling liquid introduction line 26 and each of the cooling liquid recovery lines 38 are connected to the motor-side internal space 160. Each of the cooling liquid blowout port 261 and the cooling liquid suction port 381 is formed inside the motor-side internal space 160 (in the illustrated example, the wall surface forming the motor-side internal space 160 of the outer wall 16). Note that each of the downstream end of the cooling liquid introduction line 26 and each of the cooling liquid recovery lines 38 may be connected to the compressor-side internal space 170 or the turbine-side internal space 180, or may be connected to an internal space (not shown) formed inside the compressor housing 21, or an internal space (not shown) formed inside the turbine housing 22.

According to the configuration, the cooling liquid is introduced into the motor-side internal space 160, the compressor-side internal space 170, or the turbine-side internal space 180 through the cooling liquid introduction line 26.

When the cooling liquid introduction line 26 is connected to the motor-side internal space 160, the outer wall 16 of the casing 7, the electric motor 6, and the motor compartment 13 can be cooled by the cooling liquid introduced into the motor-side internal space 160 through the cooling liquid introduction line 26. In this way, it is possible to suppress the heat generated by the electric motor 6 from being transmitted to the turbine side (the turbine-side partition wall 18 and the turbine-side internal space 180), and also suppress the heat input from the compressor side from being transmitted to the turbine side via the outer wall 16 of the casing 7 and the motor compartment 13.

When the cooling liquid introduction line 26 is connected to the compressor-side internal space 170, the cooling liquid introduced into the compressor-side internal space 170 through the cooling liquid introduction line 26 can cool the compressor-side partition wall 17, the motor compartment 13, and the compressor-side internal space 170. In this way, it is possible to suppress heat input from the compressor side from being transmitted to the electric motor 6 side (the outer wall 16 of the casing 7 and the motor compartment 13) via the compressor-side partition wall 17. In addition, by cooling the fluid that passes through the compressor impeller 4 and flows through the compressor-side storage space 11, the temperature of the fluid introduced into the compressed fluid line 23 can be reduced, thereby improving the reliability and performance of the refrigerator (refrigeration cycle) 30 including the compressed fluid line 23.

When the cooling liquid introduction line 26 is connected to the turbine-side internal space 180, the turbine-side partition wall 18 can be cooled by the cooling liquid introduced into the turbine-side internal space 180 through the cooling liquid introduction line 26. In this way, it is possible to suppress the heat input from the electric motor 6 or the compressor side from being transmitted to the turbine side via the turbine-side partition wall 18.

In some embodiments, as shown in FIG. 3, the casing 7 has the motor-side internal space 160, the compressor-side internal space 170, and a communication flow path 190 allowing communication between the motor-side internal space 160 and the compressor-side internal space 170. The cooling liquid introduction line 26 is connected to the motor-side internal space 160 or the compressor-side internal space 170.

The communication flow path 190 has a first opening 191 formed inside the motor-side internal space 160 and a second opening 192 formed inside the compressor-side internal space 170. In the illustrated embodiment, the first opening 191 is formed at the compressor side end in the axial direction of the wall surface forming the motor-side internal space 160 of the outer wall 16. The second opening 192 is formed at the outer end in the radial direction of the wall surface forming the compressor-side internal space 170 of the compressor-side partition wall 17. The casing 7 may be formed with a communication flow path (not shown) allowing communication between the motor-side internal space 160 and the turbine-side internal space 180.

According to the configuration, the cooling liquid can flow between the motor-side internal space 160 and the compressor-side internal space 170 through the communication flow path 190. This allows the cooling liquid to be introduced into both the motor-side internal space 160 and the compressor-side internal space 170, and the cooling liquid can cool the outer wall 16 of the casing 7, the compressor-side partition wall 17, and the like. In this case, since there is no need to provide a dedicated flow path for introducing the cooling liquid to each of the motor-side internal space 160 and the compressor-side internal space 170, the structure of the refrigeration system 1 can be prevented from becoming complicated.

(Heat Insulating Material)

In some embodiments, as shown in FIG. 3, the casing 7 has the turbine-side internal space 180 formed therein. The turbo machine 2 further includes a heat insulating material 180A arranged in the turbine-side internal space 180. The heat insulating material 180A has higher thermal insulation performance than a cooling liquid such as water or air. Note that a heat insulating material may be arranged inside the motor-side internal space 160 and the compressor-side internal space 170, to which no cooling liquid is introduced.

If the cooling liquid is introduced into the turbine-side internal space 180, depending on the temperature of the cooling liquid introduced into the turbine-side internal space 180, the cooling liquid may become a heat input source to be input into the turbine-side storage space 12. According to the configuration, by arranging the heat insulating material 180A in the turbine-side internal space 180, it is possible to prevent the heat insulating material 180A from becoming the heat input source, while suppressing the heat input from the electric motor 6 or the compressor side from being transmitted to the turbine side through the turbine-side partition wall 18.

In some embodiments, the fluid flowing through the refrigerator 30 consists of any one component selected from helium, hydrogen, neon, nitrogen, argon, oxygen, air, and hydrocarbons, or a mixture of two or more of these components.

According to the configuration, the fluid flowing through the refrigerator (refrigeration cycle) 30 including the compressed fluid line 23 is a refrigerant (any one component selected from helium, hydrogen, neon, nitrogen, argon, oxygen, air, and hydrocarbons, or a mixture of two or more of these components) that liquefies at a relatively low temperature, so that the temperature range that the refrigerator (refrigeration cycle) 30 can handle can be extended to extremely low temperatures and ultra-low temperatures.

In some embodiments, the refrigeration system 1, as shown in FIG. 1, includes the container body 27A, a gas suction line (the fluid introduction line 28) having the suction port 32 provided inside the container body 27A, the gas suction line being configured to guide the gas sucked from inside the container body 27A through the suction port 32 as the fluid to the compressor impeller 4, and an expansion gas line (the expansion fluid line 29) having the blowout port 33 provided inside the container body 27A, the expansion gas line being configured to guide the gas expanded by the turbine wheel 5 through the blowout port 33 into the container body 27A.

According to the configuration, a refrigerator (refrigeration cycle) 30 is constructed that uses the gas inside the container body 27A (internal gas) as a heat medium. The gas inside the container body 27A naturally circulates from the blowout port 33 to the suction port 32 due to the difference between the pressure at the blowout port 33 and the pressure at the suction port 32, so no fan is required to circulate the gas. Therefore, the temperature inside the container does not rise due to the provision of a fan and a fan motor inside the container body 27A. Therefore, the temperature inside the container is easily maintained at a desired temperature. In addition, since a fan and a fan motor are not provided inside the container body 27A, a large cargo space inside the container body 27A can be secured. Therefore, according to the configuration, a refrigeration container is obtained that is capable of preventing the reduction of the cargo space inside the container and maintaining a stable internal temperature.

In order to use a refrigeration container equipped with the container body 27A (a refrigeration container equipped with the refrigeration system 1) for transportation purposes, it is necessary to reduce the size and weight of the refrigeration system 1. If the turbo machine 2 is made smaller to meet the requirements, the distance between the compressor impeller 4 and the turbine wheel 5 will be short, and the structure will be such that heat can easily enter from the compressor side to the turbine side, so that a heat shielding structure using a cooling liquid, a heat insulating material, and the like can be particularly effective.

Some of the embodiments described below can be implemented independently. For example, some of the embodiments described below can be applied to a refrigeration system 1 that includes the cooling liquid introduction line 26, and can also be applied to a refrigeration system 1 that does not include the cooling liquid introduction line 26.

(Cooling Medium Supply Line, Cooling Medium Return Line)

Figure 4:
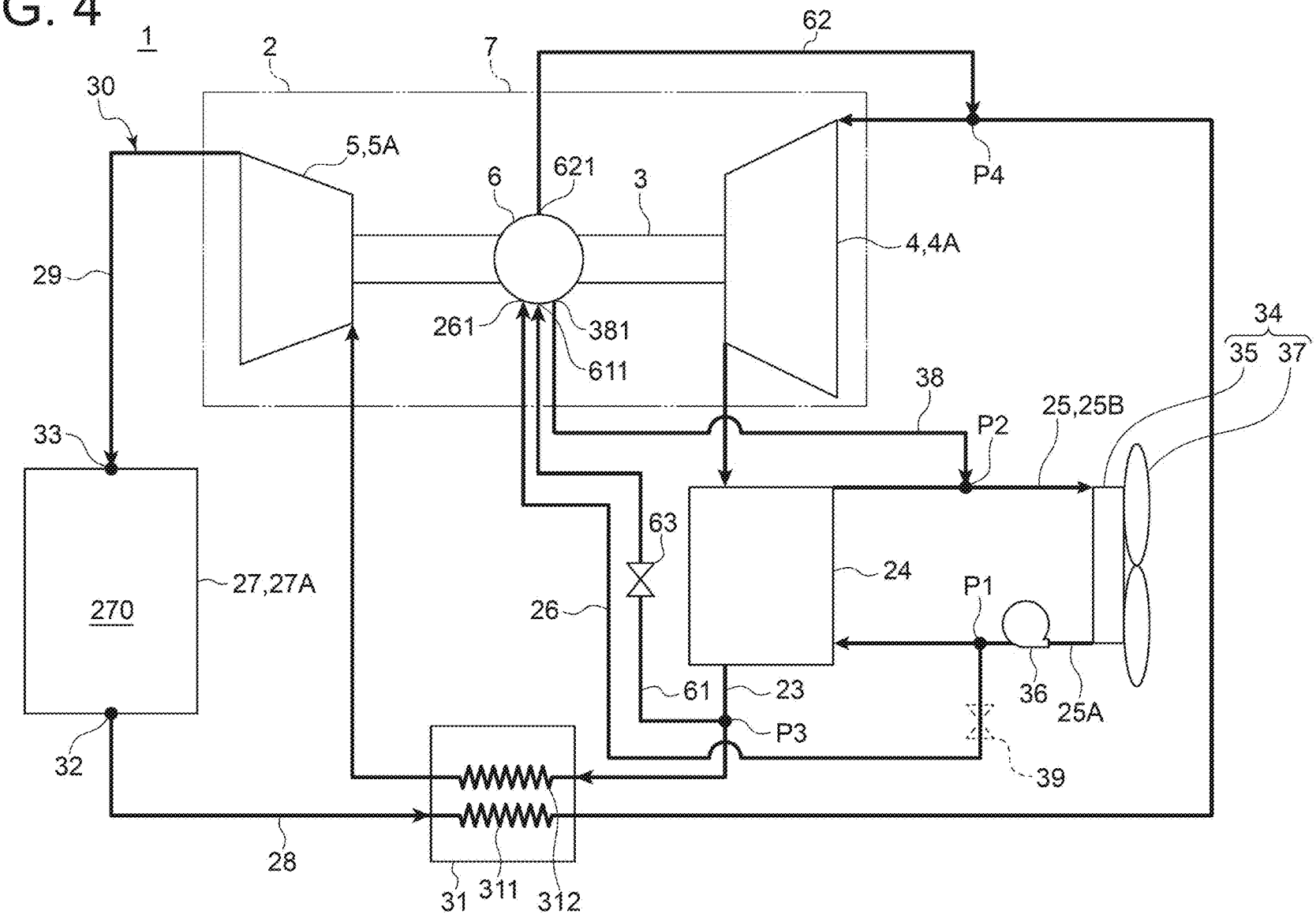
FIG. 4 is a diagram showing a schematic diagram of a refrigeration system according to an embodiment of the present disclosure.
Figure 5:
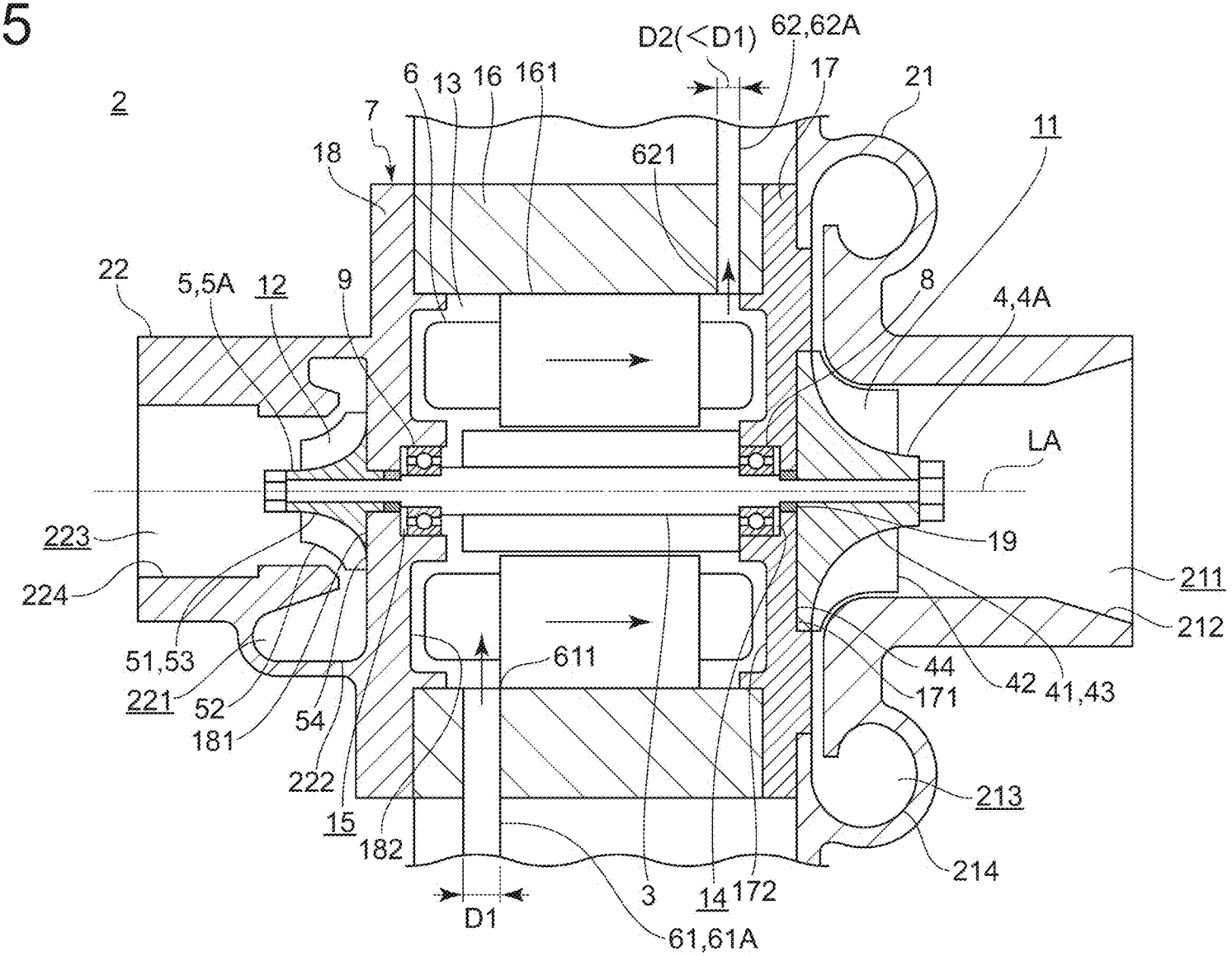
FIG. 5 is a schematic cross-sectional view along the axis of a turbo machine shown in FIG. 4.
Figure 6:
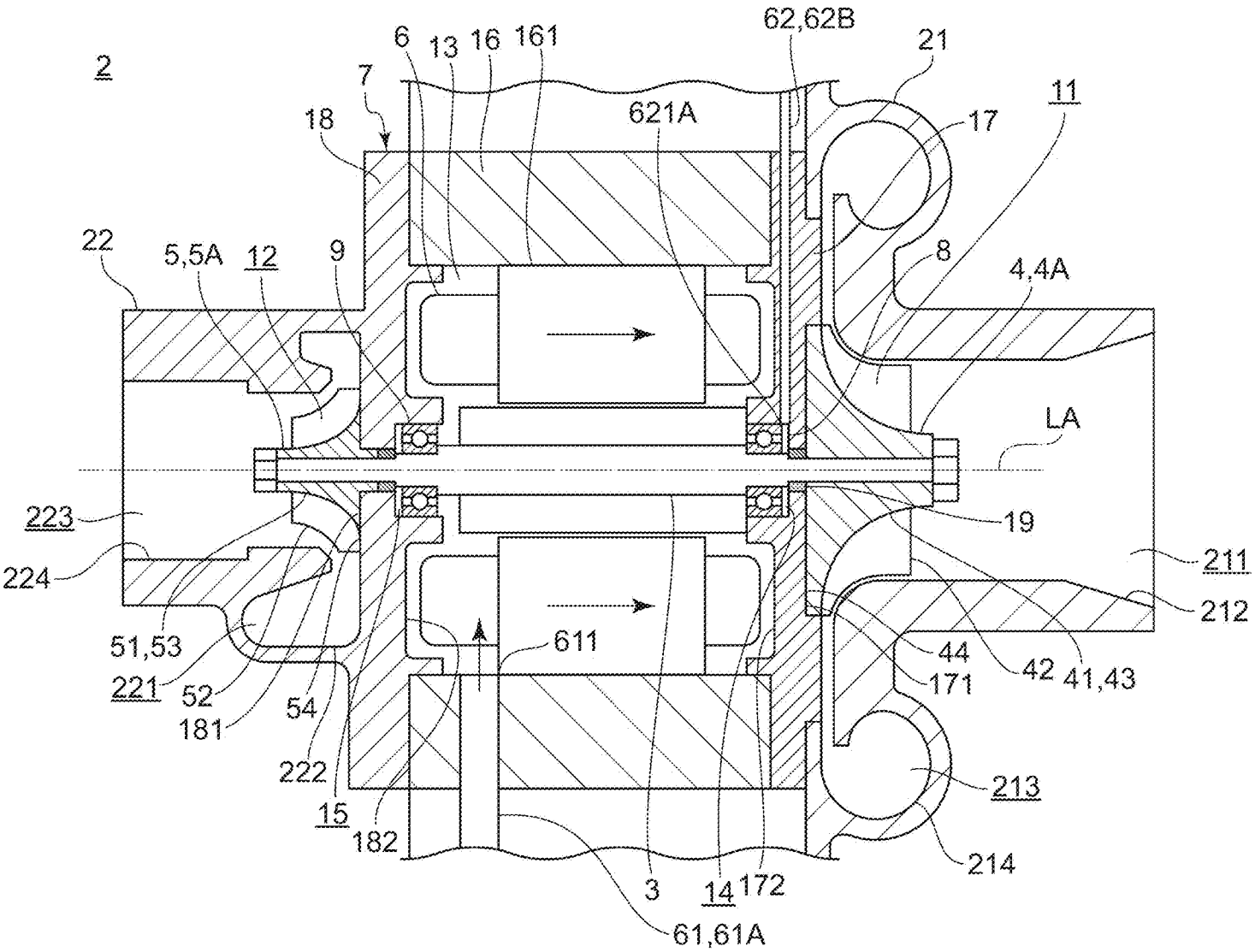
FIG. 6 is a schematic cross-sectional view along the axis of a modified example of a turbo machine shown in FIG. 5.

FIG. 4 is a diagram showing a schematic diagram of a refrigeration system 1 according to an embodiment of the present disclosure. FIG. 5 is a schematic cross-sectional view along the axis LA of the turbo machine 2 shown in FIG. 4. FIG. 6 is a schematic cross-sectional view along the axis LA of a modified example of the turbo machine 2 shown in FIG. 5. In some embodiments, the casing 7 of the refrigeration system 1 includes the motor compartment 13. As shown in FIGS. 4 to 6, the refrigeration system 1 includes at least the turbo machine 2, the compressed fluid line 23, the cooler 24, the cooling liquid circulation line 25, the cooling medium supply line 61, and the cooling medium return line 62.

The cooling medium supply line 61 has an upstream end (one end) connected to the compressed fluid line 23 downstream of the cooler 24. The cooling medium supply line 61 is a flow path for extracting fluid from the compressed fluid line 23 and supplying the fluid into the motor compartment 13 as a cooling medium for cooling the electric motor 6.

In the illustrated embodiment, the upstream end of the cooling medium supply line 61 is connected to the compressed fluid line 23 at a connection position P3 located between the cooler 24 of the compressed fluid line 23 and the heat exchanger 31 (high-temperature-side heat exchange section 312). The downstream end of the cooling medium supply line 61 is connected to the motor compartment 13.

The cooling medium return line 62 is a flow path for returning the fluid supplied into the motor compartment 13 through the cooling medium supply line 61 to the fluid introduction line 28 for guiding the fluid to the compressor impeller 4.

In the illustrated embodiment, the upstream end of the cooling medium return line 62 is connected to the motor compartment 13. The downstream end of the cooling medium return line 62 is connected to the fluid introduction line 28 at a connection position P4 located between the heat exchanger 31 (low-temperature-side heat exchange section 311) of the fluid introduction line 28 and the compressor impeller 4.

In the illustrated embodiment, the refrigeration system 1 further includes a cooling medium supply amount control device (cooling medium supply amount control valve) 63, which is provided in the cooling medium supply line 61 and configured to be able to adjust the flow rate of the gas (fluid) flowing through the cooling medium supply line 61, as shown in FIG. 4. The cooling medium supply amount control device 63 is configured to be able to adjust the flow rate of the gas (fluid) introduced downstream of the cooling medium supply amount control device 63 (cooling medium inlet port 611 side) by changing the opening degree of the valve body arranged in the cooling medium supply line 61. The cooling medium supply amount control device 63 may be an on-off valve whose opening degree can be adjusted between fully-closed and fully-open states, or may be an opening degree control valve whose opening degree can be adjusted between fully-closed and fully-open states and at least one intermediate opening degree between the states.

According to the configuration, the refrigeration system 1 includes the cooling medium supply line 61 and the cooling medium return line 62, so that the fluid cooled in the cooler 24 can be used to cool the electric motor 6 (motor compartment 13), and the fluid that has cooled the electric motor 6 can be returned to the fluid introduction line 28. In this case, a part of the refrigeration cycle (compressed fluid line 23, fluid introduction line 28, and the like) can be used as a flow path for the cooling medium (above-described fluid) that cools the electric motor 6, so that the structure of the refrigeration system 1 can be made compact and lightweight.

In some embodiments, as shown in FIG. 5, the minimum area D2 of the flow path 62A through which the cooling medium flows in the cooling medium return line 62 is smaller than the minimum area D1 of the flow path 61A through which the cooling medium flows in the cooling medium supply line 61. In the embodiment shown in FIG. 5, each of the flow paths 61A and 62A is formed inside the outer wall 16 (casing 7). In the embodiment shown in FIG. 5, the flow path 61A includes a cooling medium inlet port 611, and the flow path 62A includes a cooling medium intake port 621. In the embodiment shown in FIG. 6, the flow path 61A is formed inside the outer wall 16, and the flow path 62A is formed inside the compressor-side partition wall 17. In the embodiment shown in FIG. 6, the flow path 61A includes a cooling medium inlet port 611, and the flow path 62A includes a cooling medium intake port 621A.

According to the configuration, the minimum area D2 of the flow path 62A through which the cooling medium flows in the cooling medium return line 62 is made smaller than the minimum area D1 of the flow path 61A through which the cooling medium flows in the cooling medium supply line 61, so that the pressure inside the motor compartment 13 can be accumulated. In this way, the pressure difference between the pressure inside the motor compartment 13 and the pressure inside the compressor-side storage space 11 is made small. Thus, the leakage of the gas flowing through the compressor-side storage space 11 from the compressor-side storage space 11 to the motor compartment 13 can be reduced. Further, the temperature rise inside the motor compartment 13 due to the relatively high-temperature gas leaking from the compressor-side storage space 11 to the motor compartment 13 can be suppressed.

In some embodiments, the cooling medium supply line 61 has a cooling medium inlet port 611 for allowing the cooling medium to flow from the cooling medium supply line 61 into the motor compartment 13. The cooling medium return line 62 has a cooling medium intake port 621 for drawing the cooling medium supplied into the motor compartment 13 into the cooling medium return line 62. The cooling medium intake port 621 is formed on the side closer to the compressor impeller 4 than the cooling medium intake port 611 in the axial direction of the rotating shaft 3.

According to the configuration, the cooling medium intake port 621 is formed on the side closer to the compressor impeller 4 than the cooling medium inlet port 611 in the axial direction. In this case, gas leaking from the compressor-side storage space 11 to the motor compartment 13 or leaked gas can be quickly discharged to the cooling medium return line 62 via the cooling medium intake port 621. In this way, it is possible to suppress the temperature rise inside the motor compartment 13 due to gas leaking from the compressor-side storage space 11 to the motor compartment 13 or leaked gas.

In some embodiments, as shown in FIG. 6, the casing 7 is formed with a compressor-side communication hole 14 allowing communication between the motor compartment 13 and the compressor-side storage space 11, and the compressor-side communication hole 14 through which the rotating shaft 3 is inserted. The refrigeration system 1 includes a compressor-side bearing 8 arranged in the compressor-side communication hole 14 and configured to rotatably support the rotating shaft 3, and a compressor-side sealing portion 19 configured to seal between the compressor-side communication hole 14 and the rotating shaft 3 on a side of the compressor-side communication hole 14 closer to the compressor-side storage space 11 than the compressor-side bearing 8. The compressor-side sealing portion 19 may include a seal member that seals between the compressor-side communication hole 14 and the rotating shaft 3, or may include a mechanical seal (recess) formed in at least one of the compressor-side communication hole 14 and the rotating shaft 3.

The cooling medium return line 62 has a cooling medium intake port 621A for drawing the cooling medium supplied into the motor compartment 13 into the cooling medium return line 62. The cooling medium intake port 621A is formed between the compressor-side bearing 8 and the compressor-side sealing portion 19 in the compressor-side communication hole 14.

According to the configuration, the cooling medium intake port 621A is formed between the compressor-side bearing 8 and the compressor-side sealing portion 19 in the compressor-side communication hole 14. In this case, the relatively high-temperature gas guided from the compressor-side storage space 11 to the compressor-side communication hole 14 can be quickly discharged to the cooling medium return line 62 via the cooling medium intake port 621A. This reduces the amount of gas leaking from the compressor-side storage space 11 to the motor compartment 13, thereby suppressing the temperature rise inside the motor compartment 13 due to the leaked gas.

According to the configuration, the temperature rise of the compressor-side bearing 8 due to the relatively high-temperature gas guided to the compressor-side communication hole 14 can be suppressed. In addition, the compressor-side bearing 8 can be cooled by a fluid introduced into the motor compartment 13 through the cooling medium supply line 61. In this case, the temperature of the compressor-side bearing 8 can be kept relatively low, so that the performance degradation and thermal damage of the compressor-side bearing 8 due to temperature rise can be suppressed, and the reliability of the turbo machine 2 equipped with the compressor-side bearing 8 can be improved.

In some embodiments, at least one of the heat exchanger 31 and the cooler 24 may include a plate-type heat exchanger or a microchannel heat exchanger. The plate-type heat exchanger or the microchannel heat exchanger may be formed from a material containing aluminum or titanium.

In the present specification, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For example, an expression of an equal state such as "same", "equal" and "uniform" shall not be construed as indicating only the state in which the feature is strictly equal, but also includes a state in which there is a tolerance or a difference that can still achieve the same function.

Furthermore, in the present specification, an expression of a shape such as a rectangular shape or a cylindrical shape shall not be construed as only the geometrically strict shape, but also includes a shape with unevenness or chamfered corners within the range in which the same effect can be achieved.

Furthermore, in the present specification, an expression such as "comprise", "include", "have", "contain" and "constitute" are not intended to be exclusive of other components.

The present disclosure is not limited to the embodiments but includes modifications of the embodiments and appropriate combinations of these modifications.

The contents described in the several embodiments can be understood, for example, as follows.

1) A refrigeration system (1) according to at least one embodiment of the present disclosure includes: a turbo machine (2) including: a rotating shaft (3); a compressor impeller (4) attached to one side of the rotating shaft (3); a turbine wheel (5) attached to the other side of the rotating shaft (3); an electric motor (6) attached to the rotating shaft (3) between the compressor impeller (4) and the turbine wheel (5), the electric motor (6) being configured to generate a rotational force to rotate the rotating shaft (3); and a casing (7) configured to accommodate the rotating shaft (3), the compressor impeller (4), the turbine wheel (5), and the electric motor (6); a compressed fluid line (23) for guiding a fluid compressed by the compressor impeller (4) to the turbine wheel (5); a cooler (24) provided in the compressed fluid line (23), the cooler (24) being configured to perform heat exchange between the fluid flowing through the compressed fluid line (23) and a cooling liquid; a cooling liquid circulation line (25) for circulating the cooling liquid, the cooling liquid circulation line (25) being provided with a cooling device (34) for cooling the cooling liquid; and a cooling liquid introduction line (26) for extracting the cooling liquid from the cooling liquid circulation line (25) and introducing the cooling liquid into the casing (7).

According to the configuration 1), the cooling liquid circulating through the cooling liquid circulation line (25) is cooled in the cooling device (34), so that a relatively low temperature is maintained. The refrigeration system (1) can cool the inside of the casing (7) (turbo machine 2) by extracting the cooling liquid from the cooling liquid circulation line (25) through the cooling liquid introduction line (26) and introducing the cooling liquid into the casing (7) of the turbo machine (2). Furthermore, according to the configuration 1), the cooling liquid circulation line (25) provided in the refrigeration system (1) can be used as a cooling device for cooling the inside of the casing (7), and since there is no need to provide the cooling device separately, the structure of the refrigeration system (1) provided with the turbo machine (2) can be prevented from becoming complicated.

2) In some embodiments, in the refrigeration system (1) according to 1), the casing (7) is formed with at least one of: a motor-side internal space (160) formed inside an outer wall (16) of the casing (7) covering an outer circumferential side of a motor compartment (13) housing the electric motor (6); a compressor-side internal space (170) formed inside a compressor-side partition wall (17) separating a compressor-side storage space (11) housing the compressor impeller (4) from the motor compartment (13); and a turbine-side internal space (180) formed inside a turbine-side partition wall (18) separating a turbine-side storage space (12) housing the turbine wheel (5) from the motor compartment (13), and the cooling liquid introduction line (26) is connected to either the motor-side internal space (160), the compressor-side internal space (170), or the turbine-side internal space (180).

According to the configuration 2), the cooling liquid is introduced into the motor-side internal space (160), the compressor-side internal space (170), or the turbine-side internal space (180) through the cooling liquid introduction line (26).

The outer wall (16) of the casing (7), the electric motor (6), and the motor compartment (13) can be cooled by the cooling liquid introduced into the motor-side internal space (160). In this way, it is possible to suppress the heat generated by the electric motor (6) from being transmitted to the turbine side (the turbine-side partition wall (18) and the turbine-side internal space (180)), and also suppress the heat input from the compressor side from being transmitted to the turbine side via the outer wall (16) of the casing (7) and the motor compartment (13).

The compressor-side partition wall (17), the motor compartment (13), and the compressor-side internal space (170) can be cooled by the cooling liquid introduced into the compressor-side internal space (170). In this way, it is possible to suppress heat input from the compressor side from being transmitted to the electric motor (6) side (the outer wall (16) of the casing (7) and the motor compartment (13)) via the compressor-side partition wall (17). In addition, by cooling the fluid that passes through the compressor impeller (4) and flows through the compressor-side storage space (11), the temperature of the fluid introduced into the compressed fluid line (23) can be reduced, thereby improving the reliability and performance of the refrigerator (30) (refrigeration cycle) including the compressed fluid line (23).

The turbine-side partition wall (18) can be cooled by the cooling liquid guided to the turbine-side internal space (180). In this way, it is possible to suppress the heat input from the electric motor (6) or the compressor side from being transmitted to the turbine side via the turbine-side partition wall (18).

3) In some embodiments, in the refrigeration system (1) according to 2), the casing (7) is formed with the motor-side internal space (160), the compressor-side internal space (170), and a communication flow path (190) allowing communication between the motor-side internal space (160) and the compressor-side internal space (170), and the cooling liquid introduction line (26) is connected to the motor-side internal space (160) or the compressor-side internal space (170).

According to the configuration 3), the cooling liquid can flow between the motor-side internal space (160) and the compressor-side internal space (170) through the communication flow path (190). This allows the cooling liquid to be introduced into both the motor-side internal space (160) and the compressor-side internal space (170), and the outer wall (16) of the casing (7), the compressor-side partition wall (17), and the like can be cooled by the cooling liquid. In this case, since there is no need to provide a dedicated flow path for introducing the cooling liquid to each of the motor-side internal space (160) and the compressor-side internal space (170), the structure of the refrigeration system (1) can be prevented from becoming complicated.

4) In some embodiments, in the refrigeration system (1) according to 2) or 3), the casing (7) has the turbine-side internal space (180) formed therein, and the turbo machine (2) further includes a heat insulating material (180A) arranged in the turbine-side internal space (180).

If the cooling liquid is introduced into the turbine-side internal space (180), depending on the temperature of the cooling liquid introduced into the turbine-side internal space (180), the cooling liquid may become a heat input source to be input into the turbine-side storage space (12). According to the configuration 4), by arranging the heat insulating material (180A) in the turbine-side internal space (180), it is possible to prevent the heat insulating material (180A) from becoming the heat input source, while suppressing the heat input from the electric motor (6) or the compressor side from being transmitted to the turbine side through the turbine-side partition wall (18).

5) In some embodiments, in the refrigeration system (1) according to any one of 1) to 4), the cooling liquid circulation line (25) includes: a cooling liquid supply line (25A) for sending the cooling liquid from the cooling device (34) to the cooler (24); and a cooling liquid return line (25B) for sending the cooling liquid from the cooler (24) to the cooling device (34), and the cooling liquid introduction line (26) is connected to the cooling liquid supply line (25A).

According to the configuration 5), the cooling liquid cooled by the cooling device (34) can be introduced into the casing (7). In this case, the cooling liquid introduced into the casing (7) can be cooled to a lower temperature than when the cooling liquid that has been heated by passing through the cooler (24) is introduced into the casing (7), so that the inside of the casing (7) can be cooled more effectively by the cooling liquid.

6) In some embodiments, in the refrigeration system (1) according to any one of 1) to 5), the fluid consists of any one component selected from helium, hydrogen, neon, nitrogen, argon, oxygen, air, and hydrocarbons, or a mixture of two or more of these components.

According to the configuration 6), the fluid flowing through the refrigerator (30) (refrigeration cycle) including the compressed fluid line (23) is a refrigerant (any one component selected from helium, hydrogen, neon, nitrogen, argon, oxygen, air, and hydrocarbons, or a mixture of two or more of these components) that liquefies at a relatively low temperature, so that the temperature range that the refrigerator (30) (refrigeration cycle) can handle can be extended to extremely low temperatures and ultra-low temperatures.

7) In some embodiments, the refrigeration system (1) according to any one of 1) to 6) further includes a container body (27A); a gas suction line (fluid introduction line 28) having a suction port (32) provided inside the container body (27A), the gas suction line being configured to guide the gas sucked from inside the container body (27A) through the suction port (32) as the fluid to the compressor impeller (4); and an expansion gas line (expansion fluid line 29) having a blowout port (33) provided inside the container body (27A), the expansion gas line being configured to guide the gas expanded by the turbine wheel (5) through the blowout port (33) into the container body (27A).

According to the configuration 7), a refrigerator (30) (refrigeration cycle) is constructed that uses the gas inside the container body (27A) (internal gas) as a heat medium. The gas inside the container body (27A) naturally circulates from the blowout port (33) to the suction port (32) due to the difference between the pressure at the blowout port (33) and the pressure at the suction port (32), so no fan is required to circulate the gas. Therefore, the temperature inside the container does not rise due to the provision of a fan and a fan motor inside the container body (27A). Therefore, the temperature inside the container is easily maintained at a desired temperature. In addition, since a fan and a fan motor are not provided inside the container body (27A), a large cargo space inside the container body (27A) can be secured. Therefore, according to the configuration 7), a refrigeration container is obtained that is capable of preventing the reduction of the cargo space inside the container and maintaining a stable internal temperature.

In order to use a refrigeration container equipped with the container body (27A) for transportation purposes, it is necessary to reduce the size and weight of the refrigeration system (1). If the turbo machine (2) is made smaller to meet the above-described requirements, the distance between the compressor impeller (4) and the turbine wheel (5) will be short, and the structure will be such that heat can easily enter from the compressor side to the turbine side, so that a heat shielding structure using a cooling liquid, a heat insulating material, and the like can be particularly effective.

8) In some embodiments, in the refrigeration system (1) according to any one of 1) to 7), the casing (7) includes a motor compartment (13) housing the electric motor (6), the refrigeration system further including: a cooling medium supply line (61) having one end connected to the compressed fluid line (23) downstream of the cooler (24), the cooling medium supply line being configured to extract the fluid from the compressed fluid line (23) and supply the fluid into the motor compartment (13) as a cooling medium for cooling the electric motor (6); and a cooling medium return line (62) for returning the fluid supplied into the motor compartment (13) through the cooling medium supply line (61) to a fluid introduction line (28) for guiding the fluid to the compressor impeller (4).

According to the configuration 8), the refrigeration system (1) includes the cooling medium supply line (61) and the cooling medium return line (62), so that the fluid cooled in the cooler (24) can be used to cool the electric motor (6) (motor compartment 13), and the fluid that has cooled the electric motor (6) can be returned to the fluid introduction line (28). In this case, a part of the refrigeration cycle (compressed fluid line 23, fluid introduction line 28, and the like) can be used as a flow path for the cooling medium (above-described fluid) that cools the electric motor (6), so that the structure of the refrigeration system (1) can be made compact and lightweight.

9) In some embodiments, in the refrigeration system (1) according to 8), a minimum area (D2) of a flow path (62A) through which the cooling medium flows in the cooling medium return line (62) is smaller than a minimum area (D1) of a flow path (61A) through which the cooling medium flows in the cooling medium supply line (61).

According to the configuration 9), the minimum area (D2) of the flow path (62A) through which the cooling medium flows in the cooling medium return line (62) is made smaller than the minimum area (D1) of the flow path (61A) through which the cooling medium flows in the cooling medium supply line (61), so that the pressure inside the motor compartment (13) can be accumulated. In this way, the pressure difference between the pressure inside the motor compartment (13) and the pressure inside the compressor-side storage space (11) is made small. Thus, the leakage of the gas flowing through the compressor-side storage space (11) from the compressor-side storage space (11) to the motor compartment (13) can be reduced. Further, the temperature rise inside the motor compartment (13) due to the relatively high-temperature gas leaking from the compressor-side storage space (11) to the motor compartment (13) can be suppressed.

10) In some embodiments, in the refrigeration system (1) according to 8) or 9), the cooling medium supply line (61) has a cooling medium inlet port (611) for allowing the cooling medium to flow from the cooling medium supply line (61) into the motor compartment (13), the cooling medium return line (62) has a cooling medium intake port (621) for drawing the cooling medium supplied into the motor compartment (13) into the cooling medium return line (62), and the cooling medium intake port (621) is formed on a side closer to the compressor impeller (6) than the cooling medium inlet port (611) in an axial direction of the rotating shaft (3).

According to the configuration 10), the cooling medium intake port (621) is formed on the side closer to the compressor impeller (4) than the cooling medium inlet port (611) in the axial direction. In this case, gas leaking from the compressor-side storage space (11) to the motor compartment (13) or leaked gas can be quickly discharged to the cooling medium return line (62) via the cooling medium intake port (621). In this way, it is possible to suppress the temperature rise inside the motor compartment (13) due to gas leaking from the compressor-side storage space (11) to the motor compartment (13) or leaked gas.

11) In some embodiments, in the refrigeration system (1) according to any one of 8) to 10), the casing (7) is provided with a compressor-side communication hole (14) allowing communication between a motor compartment (13) housing the electric motor (6) and a compressor-side storage space (11) housing the compressor impeller (4), the rotating shaft (3) being inserted through the compressor-side communication hole (14), the refrigeration system (1) further including: a compressor-side bearing (8) disposed in the compressor-side communication hole (14) and configured to rotatably support the rotating shaft (3); and a compressor-side sealing portion (19) configured to seal between the compressor-side communication hole (14) and the rotating shaft (3) on a side of the compressor-side communication hole (14) closer to the compressor-side storage space (11) than the compressor-side bearing (8), the cooling medium return line (62) has a cooling medium intake port (621A) for drawing the cooling medium supplied into the motor compartment (13) into the cooling medium return line (62), and the cooling medium intake port (621A) is formed between the compressor-side bearing (8) and the compressor-side sealing portion (19) in the compressor-side communication hole (14).

According to the configuration 11), the cooling medium intake port (621A) is formed between the compressor-side bearing (8) and the compressor-side sealing portion (19) in the compressor-side communication hole (14). In this case, the relatively high-temperature gas guided from the compressor-side storage space (11) to the compressor-side communication hole (14) can be quickly discharged to the cooling medium return line (62) via the cooling medium intake port (621A). This reduces the amount of gas leaking from the compressor-side storage space (11) to the motor compartment (13), thereby suppressing the temperature rise inside the motor compartment (13) due to the leaked gas.

According to the configuration 11), the temperature rise of the compressor-side bearing (8) due to the relatively high-temperature gas guided to the compressor-side communication hole (14) can be suppressed. In addition, the compressor-side bearing (8) can be cooled by a fluid introduced into the motor compartment (13) through the cooling medium supply line (61). In this case, the temperature of the compressor-side bearing (8) can be kept relatively low, so that the performance degradation and thermal damage of the compressor-side bearing (8) due to temperature rise can be suppressed, and the reliability of the turbo machine (2) equipped with the compressor-side bearing (8) can be improved.

REFERENCE SIGNS LIST

1 Refrigeration system
2 Turbo machine

3 Rotating shaft
4 Compressor impeller
4A Centrifugal compressor
5 Turbine wheel
5A Expander
6 Electric motor
7 Casing
8 Compressor-side bearing
9 Turbine-side bearing
11 Compressor-side storage space
12 Turbine-side storage space
13 Motor compartment
14 Compressor-side communication hole
15 Turbine-side communication hole
16 Outer wall
17 Compressor-side partition wall
18 Turbine-side partition wall
19 Compressor-side sealing portion
21 Compressor housing
22 Turbine housing
23 Compressed fluid line
24 Cooler
25 Cooling liquid circulation line
25A Cooling liquid supply line
25B Cooling liquid return line
26 Cooling liquid introduction line
27 Fluid supply destination
27A Container body
28 Fluid introduction line
29 Expansion fluid line
30 Refrigerator
31 Heat exchanger
32 Suction port
33 Blowout port
34 Cooling device
35 Radiator
36 Pump
37 Far
38 Cooling liquid recovery line
39 Cooling liquid flow rate control device
41, 51 Hub
42 Impeller blade
43, 53 Outer circumferential surface
44, 54 Back surface
52 Turbine blade
61 Cooling medium supply line
62 Cooling medium return line
63 Cooling medium supply amount control device
160 Motor-side internal space
161 Inner surface
170 Compressor-side internal space
171 Compressor-side back surface
172 Compressor-side inner surface
180 Turbine-side internal space
180A Heat insulating material
181 Turbine-side back surface
182 Turbine side inner surface
190 Communication flow path
191 First opening
192 Second opening
211 Fluid introduction flow path
212 Fluid introduction flow path forming section
213, 221 Scroll flow path
214, 222 Scroll flow path forming section
223 Fluid discharge flow path
224 Discharge flow path forming section
261 Cooling liquid blowout port
270 Inner space
311 Low-temperature-side heat exchange section
312 High temperature-side heat exchange section
381 Cooling liquid suction port
611 Cooling medium inlet port
621,621A Cooling medium intake port
D1, D2 Minimum area
LA Axis
P1, P2, P3, P4 Connection position

The invention claimed is:

1. A refrigeration system comprising:
a turbo machine including:
a rotating shaft;
a compressor impeller attached to one side of the rotating shaft;
a turbine wheel attached to the other side of the rotating shaft;
an electric motor attached to the rotating shaft between the compressor impeller and the turbine wheel, the electric motor being configured to generate a rotational force to rotate the rotating shaft; and
a casing configured to accommodate the rotating shaft, the compressor impeller, the turbine wheel, and the electric motor;
a compressed fluid line for guiding a fluid compressed by the compressor impeller to the turbine wheel;
a cooler provided in the compressed fluid line, the cooler being configured to perform heat exchange between the fluid flowing through the compressed fluid line and a cooling liquid;
a cooling liquid circulation line for circulating the cooling liquid, the cooling liquid circulation line being provided with a cooling device for cooling the cooling liquid; and
a cooling liquid introduction line for extracting the cooling liquid from the cooling liquid circulation line and introducing the cooling liquid into the casing, wherein
the casing includes a motor compartment housing the electric motor,
the refrigeration system further comprises:
a cooling medium supply line having one end connected to the compressed fluid line downstream of the cooler, the cooling medium supply line being configured to extract the fluid from the compressed fluid line and supply the fluid into the motor compartment as a cooling medium for cooling the electric motor; and
a cooling medium return line for returning the fluid supplied into the motor compartment through the cooling medium supply line to a fluid introduction line for guiding the fluid to the compressor impeller, and
a minimum area of a flow path through which the cooling medium flows in the cooling medium return line is smaller than a minimum area of a flow path through which the cooling medium flows in the cooling medium supply line.

2. The refrigeration system according to claim 1, wherein the casing is formed with at least one of:
a motor-side internal space formed inside an outer wall of the casing covering an outer circumferential side of a motor compartment housing the electric motor;
a compressor-side internal space formed inside a compressor-side partition wall separating a compressor-side storage space housing the compressor impeller from the motor compartment; and a turbine-side internal space formed inside a turbine-side partition wall separating a turbine-side storage space housing the turbine wheel from the motor compartment, and the cooling liquid introduction line is connected to either the motor-side internal space, the compressor-side internal space, or the turbine-side internal space.

3. The refrigeration system according to claim 2, wherein the casing is formed with the motor-side internal space, the compressor-side internal space, and a communication flow path allowing communication between the motor-side internal space and the compressor-side internal space, and the cooling liquid introduction line is connected to the motor-side internal space or the compressor-side internal space.

4. The refrigeration system according to claim 2, wherein the casing has the turbine-side internal space formed therein, and the turbo machine further includes a heat insulating material arranged in the turbine-side internal space.

5. The refrigeration system according to claim 1, wherein the cooling liquid circulation line includes:

a cooling liquid supply line for sending the cooling liquid from the cooling device to the cooler; and a cooling liquid return line for sending the cooling liquid from the cooler to the cooling device, and the cooling liquid introduction line is connected to the cooling liquid supply line.

6. The refrigeration system according to claim 1, wherein the fluid consists of any one component selected from helium, hydrogen, neon, nitrogen, argon, oxygen, air, and hydrocarbons, or a mixture of two or more of these components.

7. The refrigeration system according to claim 1, further comprising:

a container body;

a gas suction line having a suction port provided inside the container body, the gas suction line being configured to guide a gas sucked from inside the container body through the suction port as the fluid to the compressor impeller; and an expansion gas line having a blowout port provided inside the container body, the expansion gas line being configured to guide the gas expanded by the turbine wheel through the blowout port into the container body through the suction port.

8. The refrigeration system according to claim 1, wherein the cooling medium supply line has a cooling medium intake port for allowing the cooling medium to flow from the cooling medium supply line into the motor compartment, the cooling medium return line has a cooling medium intake port for drawing the cooling medium supplied into the motor compartment into the cooling medium return line, and the cooling medium intake port is formed on a side closer to the compressor impeller than the cooling medium intake port in an axial direction of the rotating shaft.

9. A refrigeration system comprising:

a turbo machine including:

a rotating shaft;

a compressor impeller attached to one side of the rotating shaft;

a turbine wheel attached to the other side of the rotating shaft;

an electric motor attached to the rotating shaft between the compressor impeller and the turbine wheel, the electric motor being configured to generate a rotational force to rotate the rotating shaft; and a casing configured to accommodate the rotating shaft, the compressor impeller, the turbine wheel, and the electric motor;

a compressed fluid line for guiding a fluid compressed by the compressor impeller to the turbine wheel;

a cooler provided in the compressed fluid line, the cooler being configured to perform heat exchange between the fluid flowing through the compressed fluid line and a cooling liquid;

a cooling liquid circulation line for circulating the cooling liquid, the cooling liquid circulation line being provided with a cooling device for cooling the cooling liquid; and a cooling liquid introduction line for extracting the cooling liquid from the cooling liquid circulation line and introducing the cooling liquid into the casing, wherein the casing includes a motor compartment housing the electric motor, the refrigeration system further comprises:

a cooling medium supply line having one end connected to the compressed fluid line downstream of the cooler, the cooling medium supply line being configured to extract the fluid from the compressed fluid line and supply the fluid into the motor compartment as a cooling medium for cooling the electric motor; and a cooling medium return line for returning the fluid supplied into the motor compartment through the cooling medium supply line to a fluid introduction line for guiding the fluid to the compressor impeller, the casing is provided with a compressor-side communication hole allowing communication between a motor compartment housing the electric motor and a compressor-side storage space housing the compressor impeller, the rotating shaft being inserted through the compressor-side communication hole, the refrigeration system further comprises:

a compressor-side bearing disposed in the compressor-side communication hole and configured to rotatably support the rotating shaft, and a compressor-side sealing portion configured to seal between the compressor-side communication hole and the rotating shaft on a side of the compressor-side communication hole closer to the compressor-side storage space than the compressor-side bearing, the cooling medium return line has a cooling medium intake port for drawing the cooling medium supplied into the motor compartment into the cooling medium return line, and the cooling medium intake port is formed between the compressor-side bearing and the compressor-side sealing portion in the compressor-side communication hole.

* * * * *